US007534314B2

(12) United States Patent
Frommeyer et al.

(10) Patent No.: US 7,534,314 B2
(45) Date of Patent: May 19, 2009

(54) HIGH CARBON STEEL WITH SUPERPLASTICITY

(75) Inventors: Georg Frommeyer, Erkrath (DE); Arndt Gerick, Ulm (DE); Tilmann Haug, Wiessenhorn (DE); Wolfgang Kleinekathöfer, Waldstetten (DE)

(73) Assignee: Daimler AG, Stuttgart (DE)

( * ) Notice: Subject to any disclaimer, the term of this patent is extended or adjusted under 35 U.S.C. 154(b) by 232 days.

(21) Appl. No.: 11/451,695

(22) Filed: Jun. 13, 2006

(65) Prior Publication Data

US 2007/0107816 A1 May 17, 2007

(30) Foreign Application Priority Data

Jun. 13, 2005 (DE) ..... 10 2005 027 258

(51) Int. Cl.
*C21D 1/84* (2006.01)
*C22C 38/06* (2006.01)

(52) U.S. Cl. ..... 148/543; 148/544; 148/564

(58) Field of Classification Search ..... 148/543, 148/544, 545, 564
See application file for complete search history.

(56) References Cited

U.S. PATENT DOCUMENTS 5,445,685 A * 8/1995 Strum et al. ..... 148/324
6,764,560 B1 * 7/2004 Mogilevsky ..... 148/543

FOREIGN PATENT DOCUMENTS

EP 0 695 811 A1 2/1996

OTHER PUBLICATIONS

Frommeyer et al.: "Structural Superplasticity at Higher Strain Rates of Hypereutectoid Fe-5.5Al-1Sn-1Cr-1.3C Steel," Metallurgical and Materials Transactions A, 2005, pp. 295-300, vol. 36A, No. 2, Pittsburgh, PA, USA.
Schröder: "Ausgekochter Stahl Für das Auto von morgen," MaxPlanckForschung, 2004, pp. 36-41, Germany.

* cited by examiner

*Primary Examiner*—George Wyszomierski
(74) *Attorney, Agent, or Firm*—Patent Central LLC; Stephen A. Pendorf

(57) ABSTRACT

A density reducing high carbon containing or UHC-steel and particular a superplastic steel, which besides iron and impurities conventionally accompanying steel, contains the following alloy components in wt. %:

0.8 to 2.5% C 3.5 to 15% Al 0.5 to 4% Cr 0.01 to 4% Si up to 4% Ni, Mn, Mo, Nb, Ta, V, and/or W, wherein the steel includes as additional alloy components 0.1 to 0.85 Sn, and 0 to 3% Ti, Be and/or Ga.

3 Claims, No Drawings

HIGH CARBON STEEL WITH SUPERPLASTICITY

BACKGROUND OF THE INVENTION

1. Field of the Invention

The invention concerns a density reducing high carbon content steel or a UHC-steel (Ultra High Carbon) which contains, besides iron and conventional impurities, from 0.8 to 2.5% C, 3.5 to 15% Al, 0.5 to 5% Cr, 0.01 to 4% Si, and up to 4% Ni, Mn, Mo, Nb, Ta, V, and/or W, as well as additional alloy components 0.1 to 0.85 Sn and 0 to 3% Ti, Be and/or Ga. In particular, the invention concerns superplastic UHC-steels.

The term "superplasticity", with regard to metals, is understood to mean the capacity to withstand degrees of deformation upon application of a very low yield stress, without lateral contraction and practically no work hardening, which compared to materials having normal plasticity of approximately 10 to 40%, is several hundred to over 1000% for superplastic materials. A fundamental characteristic of the superplastic behavior of materials is the strong dependence of the yield strength on the rate of elongation or, as the case may be, elongation rate ($\epsilon$ ).

Superplastic deformation occurs using time controlled diffusion processes, during which very fine and often also rounded crystallites flow and rotate past each other. Thus, only a very narrow process window of temperature and deformation speed (elongation rate) ($\epsilon$ ) is allowed, in order to achieve the elongation values of the superplastic deformation of several 100 to 1000%. Typically herein a higher deformation temperature, above approximately 50% of the melting temperature (in ° C.), and a very low deformation speed of approximately $10^{-2}$ to $10^{-5}$ $s^{-1}$, can be mentioned as guide.

2. Description of the Related Art

In machine construction and in the automobile industry superplastic metals offer a high potential in order to produce components with a high degree of deformation. Superplastic alloys are known for example from FR 274 1360 Al, U.S. Pat. No. 5,672,315, EP 1 252 352 Al, or U.S. 2001 020 502.

From U.S. Pat. No. 5,445,685 UHC-steels with 0.5 to 2.1% carbon and the following additional essential alloy components are known:

0.5 to 10% Al, 1 to 16% Cr and optionally 0.2 to 2% Mn 0.5 to 10% Al, 0.25 to 5% Mo, 0.25 to 5% Cr and optionally 0.2 to 2% Mn 0.5 to 10% Al, 0.25 to 5% Si, 1 to 7% Cr, and optionally 0.2 to 2% Mn 0.5 to 10% Al, 0.25 to 5% Ni, 1 to 7% Cr, and optionally 0.2 to 2% Mn 0.5 to 10% Al, 0.5 to 10% Mn, 0.5 to 7% Cr.

For adjusting the superplastic characteristic a special controlled cooling is carried out, which leads to the formation of spheric carbides.

For the mass production of components of interest it is important to have, besides the very high maximal degree of deformation, likewise also a high speed of deformation. Since acceptable deformation speeds can be realized only at elevated temperatures, the scaling or oxidation of the alloys during the deformation process can lead to a substantial problem. This applies particularly for Ta/Al alloys, however also for steels.

In order to meet the requirements of light construction in the motor vehicle industry, steels with reduced density are of particular interest.

SUMMARY OF THE INVENTION

It is thus the task of the invention to provide a steel composition, into which a superplastic characteristic can be imparted, however while at the same time exhibiting a low as possible tendency towards scaling and a low density.

This task is inventively solved by a density reducing high carbon containing or UCH-steel, which contains, besides iron and the impurities conventionally found in steel, the following alloy components in weight % (unless otherwise specified, all % are wt. %):

0.8 to 2.5% C 3.5 to 15% Al 0.5 to 4% Cr 0.01 to 4% Si up to 4% Ni, Mn, Mo, Nb, Ta, V, and/or W 0.1 to 0.85 Sn, 0 to 3% of Ti, Be and/or Ga.

In accordance with the invention, a UCH-steel is provided, which contains Sn as an essential further alloy component. The Sn therein acts favorably on the formation particularly fine phases of α-ferrite and κ-carbide and cementite. Thereby, an improvement in the scale resistance and the superplastic characteristics is brought about. Comparatively low temperatures are needed for the deformation.

In a preferred embodiment of the invention the Sn-content lies at only 0.3 to 0.5 wt. %.

By having an Al-content of up to 15%, substantial savings in weight are made possible in comparison to convention steels. Beyond this, the high Al-content brings about a substantial reduction in scale formation. The preferred alloy compositions include those with an Al-content of 8 to 15% and particularly preferably from 10 to 14%.

Preferably, the alloy contains, as additional components, Ti, Be and/or Ga in an amount of up to 3%. Particularly preferred is at least one of these elements in an amount of 0.5 to 2.5%.

It is further of advantage when the content of Ti is 1.5 to 3 wt. %, or when the sum of Ti, Be and Ga is at most 3%.

One preferred composition is characterized by an Al-content of greater than 10 wt. %, a Si-content of above 2 wt. % and a Sn-content of above 0.4 wt. %.

Following their metallurgic production, the steels are not in a micro-structure condition which exhibits the optimal superplastic characteristics. Only by a particular thermal-mechanical treatment is a micro-structure formed which contains the ultra fine crystallite, in particular grains, which are necessary for the superplasticity of the UHC-steels. At least two phases must be formed in order to prevent nucleation or grain growth. The corresponding phases are thus essentially comprised in the inventive composition of the main phase α-ferrite and the minor phase kapp-carbide and cementite. In order to adjust this micro-structure, first a relatively homogenous material of perlite is produced, which is a lamellar mixture of ferrite and cementite. In a second step this perlite-structure is transformed into the superplastic micro structure, in which the carbide is present primarily spheriodically and the ferrite in the form of ultra-fine grains.

Preferably, the steel is comprised primarily of two phases, with 65 to 85 vol. % α-ferrite and 15 to 25% vol. % κ-carbide and cementite. Particularly preferred is the presence of a third Sn-rich phase as minor component. This includes preferably almost the entirety of the Sn contained in the alloy. The proportion of this third phase lies preferably at 1 to 5 vol. %.

We claim:

1. A method for manufacture of components for motor vehicles, comprising:

(a) forming density reducing high carbon steel, which contains, besides iron and conventional steel impurities, the following alloy components in wt. %:

0.8 to 2.5% C 8 to 15% Al 0.5 to 4% Cr 0.01 to 4% Si up to 5% Ni, Mn, Mo, Nb, Ta, V, and/or W 0.1 to 0.85 Sn and 0 to 3% Ti, Be and/or Ga;

(b) melting the steel;

(c) subjecting the steel to a targeted cooling process, which leads to a substantial two phase micro-structure with 65 to 85 vol. % α-Ferrite and 15 to 25 vol. % κ-carbide and cementite, whereby the steel exhibits a micro-structure with superplastic characteristics, and (d) deforming the steel to produce said component for said motor vehicle.

2. The method according to claim 1, wherein said components for said motor vehicle are selected from components for internal combustion engines and transmission components of motor vehicles.

3. A process for producing a superplastic high carbon steel, comprising:

(a) preparing a melt, which comprises, besides iron and conventional steel impurities, the following alloy components in wt. %:

0.8 to 2.5% C 8 to 15% Al 0.5 to 4% Cr 0.01 to 4% Si up to 5% Ni, Mn, Mo, Nb, Ta, V, and/or W and 0 to 3% Ti, Be and/or Ga and (b) subjecting the molten steel to a targeted cooling process, which leads to a substantial two phase micro-structure with 65 to 85 vol. % α-Ferrite and 15 to 25 vol. % κ-carbide and cementite.

* * * * *